United States Patent [19]

Spira et al.

[11] 4,207,498

[45] Jun. 10, 1980

[54] SYSTEM FOR ENERGIZING AND DIMMING GAS DISCHARGE LAMPS

[75] Inventors: Joel S. Spira, Allentown; Dennis Capewell, Easton; David G. Luchaco, Macungie, all of Pa.

[73] Assignee: Lutron Electronics Co., Inc., Coopersburg, Pa.

[21] Appl. No.: 966,604

[22] Filed: Dec. 5, 1978

[51] Int. Cl.[2] ..... H05B 41/26; H05B 41/392

[52] U.S. Cl. ..... 315/97; 315/210; 315/224; 315/201; 315/137; 315/DIG. 4

[58] Field of Search ..... 315/95-98, 315/137, 201, 210, 224, DIG. 4

[56] References Cited

U.S. PATENT DOCUMENTS

| | | | |
|---|---|---|---|
| 3,422,309 | 1/1969 | Spira et al. | 315/DIG. 4 |
| 3,619,716 | 11/1971 | Spira et al. | 315/244 |
| 3,731,142 | 5/1973 | Spira et al. | 315/94 |
| 3,753,071 | 8/1973 | Engel et al. | 315/201 |
| 3,824,428 | 7/1974 | Spira et al. | 315/105 |
| 3,919,592 | 11/1975 | Gray | 315/199 |

*Primary Examiner*—Alfred E. Smith
*Assistant Examiner*—Charles F. Roberts
*Attorney, Agent, or Firm*—Ostrolenk, Faber, Gerb & Soffen

[57] ABSTRACT

An illumination control system for gas discharge lamps which can be dimmed is provided in which a central inverter produces an output voltage at a high frequency which can be about 23 kHz. The amplitude of the inverter output is adjustable to dim the lamps. A transmission line consisting of spaced wires having respective thick insulation sheaths distributes the high frequency power to remotely located assemblies of ballasts and lamps. The ballasts consist of passive linear components. A high power factor rectifier network is disclosed for providing a d-c input to the inverter from the 50/60 Hz mains.

42 Claims, 5 Drawing Figures

SYSTEM FOR ENERGIZING AND DIMMING GAS DISCHARGE LAMPS

BACKGROUND OF THE INVENTION

This invention relates to the energization of gas discharge lamps, and more specifically relates to novel energy conservation circuits for energizing and controlling the illumination output of gas-filled lamps and high intensity discharge lamps.

To conserve energy in lighting applications using gas discharge lamps, it is known that the lamps should be energized from a relatively high frequency source, and that the lamps should be dimmed if their output light is greater than needed under a given situation. For fluorescent lamps, the use of a frequency of about 20 kHz will reduce energy consumption by more than about 20%, as compared to energization at 60 Hz. For high intensity discharge lamps, such as those using mercury vapor, metal halide and sodium, the saving in energy exists but is somewhat less than for a fluorescent lamp. Numerous publications deal with the desirability of high frequency energization of gas discharge lamps, including, for example:

Federal Construction Council, *High-Frequency Lighting,* Technical Report No. 53, National Academy of Sciences Publication No. 1610, 1968, p. 6–30;

Campbell, J. H., *New Parameters for High Frequency Lighting Systems.* Illuminating Engineering, V. 55, May 1960, p. 247–254; discussion, p. 254–256;

Campbell, J. H., Schultz, H. E., and Schlick, J. A., *A New 3000-Cycle Fluorescent-Lighting System.* IEEE Transactions on Industry and General Applications, Vol. IGA-1, Jan.-Feb. 1965, p. 19–24;

Campbell, J. H. Schultz, H. E. and Schlick, J. A., *Characteristics of a New 3000-CPS Systems for Industrial and Commercial Use.* Illuminating Engineering, V. 60, March 1965, p. 148–152;

Dobras, Q. D., *Status of High Frequency Lighting.* General Electric Architects and Engineers Conference, April 1963, p. 17 –24;

Northern Illinois Gas Company, *High Frequency Lighting at our General Office,* June 1970; and Wolfframm, B. M., *Solid State Ballasting of Fluorescent and Mercury Lamps. IEEE Conference Record of* 4th Annual Meeting of the Industry & General Applications Group, Oct. 12–16, 1969, p. 381–386.

Energy saved by dimming gas discharge lamps depends on the degree of dimming which is permitted in a given situation. The light output of a lamp is roughly proportional to the power expended. Thus, at 50% light output, only about 50% of the full rated power is expended.

Many applications exist where it is acceptable or desirable to decrease the amount of light from a lamp. For example, light in a building might be decreased uniformly or locally in the presence of sunlight coming through a window to maintain a constant or acceptable illumination at a work surface. Thus, during a normal work day, an energy saving of about 50% may be experienced. Light might also be decreased during non-working hours and maintained at a low level for security purposes. Light output might also be decreased, either from local controls or from signals from a generating station during periods of overload on the utility lines.

Energy savings may also be obtained by dimming lamp output when the lamps are new and have a light output much higher at a given input power than at the end of their life. Since a lighted area must be properly illuminated at the end of lamp life, energy can be saved by dimming the lamps when they are new, and then reducing the dimming as the lamps age. Energy savings of 15% for fluorescent lamps and 20% to 30% for high intensity discharge lamps can be obtained in this fashion.

One system used at the present time to obtain the benefits of high frequency energization of gas discharge lamps distributes power at low frequency (60 Hz) to each of the fixtures of a lighting system. Each fixture could commonly contain several lamps in parallel or series connection. Each fixture is also provided with an inverter to produce the high frequency energizing power and contains the necessary ballast circuits for the lamp. Circuits used in the individual fixture for the above type circuit are typically shown in U.S. Pat. Nos. 3,422,309, 3,619,716; 3,731,142; and 3,824,428, each in the names of Spira and Licata; and 3,919,592 in the name of Gray, each of which is assigned to the assignee of the present invention. Systems of this type are available from the Lutron Electronics Co., Inc. of Coopersburg, Pennsylvania under the trademark Hi-Lume.

While the above arrangement performs well, a complete inverter circuit and controls therefor must be placed in each fixture. Thus, the system is costly and the reliability problem is repeated for each fixture. Since each fixture receives the complete inverter circuit, designers and users are hesitant to use complex and expensive circuits and control schemes because of cost and reliability. Furthermore, each circuit exists in the relatively hot environment of the lamp fixture. The scheme also requires that four lead go to each fixture; two for power and two for the dimming signal. A further problem is that it is difficult to provide a good 50 Hz to 60 Hz power factor in each fixture since the power factor correction devices are bulky and expensive.

In another known system, a single source of high frequency is used and provides energy for a relatively short distance over relatively short power lines. Dimming is obtained by changing the inverter frequency to a capacitive ballast. An arrangement of this kind is shown in the publication Federal Construction Council, *High-Frequency Lighting,* Washington, D.C.; National Academy of Sciences, 1968, referred to above.

This arrangement has several disadvantages. First it provides relatively poor dimming. The lamps used in the system require separate filament transformers since, if high frequency is used to power the filaments, it is difficult to keep the filament voltage constant with variable frequency. The separate filament transformers are costly and further complicate the system. It is also difficult to change the inverter frequency and requires costly and complex controls. A further problem of these systems is that the load on the inverter is capacitive so that the high frequency power factor is poor. Thus, excessive current flows in the wires between the inverter and ballast, creating additional energy loss.

Other arrangements are known in which 50 Hz to 60 Hz power is supplied from a local source directly to the lamps and their ballasts, and dimming is obtained by changing the current amplitude through the use of an auto-transformer or thyristor control circuit. While this system obviously does not have the advantage of high frequency excitation for the lamps, it is also true that bulky components are needed in this fixture and a good 50/60 Hz factor is hard to obtain.

BRIEF DESCRIPTION OF THE INVENTION

In accordance with the present invention, a novel arrangement is provided wherein a central high frequency inverter is provided to energize a plurality of remote ballasts and associated gas discharge lamps with an a-c output wave form which may or may not be symmetrical. Circuits of any desired sophistication are provided for control of the central inverter and dimming is obtained by varying the amplitude of the inverter output. The connection from the inverter to the ballasts and lamps and remote fixtures is preferably by a novel low-loss transmission line consisting of a pair of spaced conductors which are each insulated by a very thick insulating sheath which minimizes their capacitive coupling to one another and to the grounded conduit in which they are located. It also minimizes magnetic field coupling to an iron or ferrous material conduit, and thus the iron losses in the conduit. Moreover, the structure permits use of a ferrous metal conduit. Furthermore, magnetic coupling proximity effect losses are minimized by the novel heavily insulated transmission line.

The ballasts used with the lamps are those which preferably use passive and linear components, but they could be active and/or non-linear. A passive ballast is defined herein as one using only resistors, inductors, transformers and capacitors. An active ballast is one using amplifier components such as transistors, thyristors, magnetic amplifiers, and the like. A linear component is one having a fairly linear relationship between input and output.

The output current wave shape of the inverter of the invention is preferably sinusoidal but, in general, it is a substantially continuous periodic wave form. By a substantially continuous periodic wave form is meant a wave form which has an alternating component and may or may not have a d-c component. By substantially continuous wave form is also means one which has no significant interval of "zero" current during each cycle of the high frequency output, as is present in some pulsed sources or in a phase controlled thyristor circuit. However, a continuous wave form shall include wave forms such as sinusoids; triangular wave forms; square or rectangular wave forms, each with or without d-c components. The output amplitude of the inverter may be controlled by:

(a) Phase control;

(b) Pulse width modulation with a filtering ballast; or (c) D-c input voltage.

In each of the above, there will always be continuously flowing current. By pulse width modulator above is meant fixed frequency and variable pulse width or fixed pulse width and variable frequency, or combinations thereof.

In order to maintain a high power factor, the rectifier network used in converting the frequency at the mains (50 Hz to 60 Hz) to a d-c input for the high frequency inverter is preferably that shown in copending application Ser. No. 966,603, filed Dec. 5, 1978, in the name of Dennis Capewell and assigned to the assignee of this invention. Moreover, the ballast circuits used in the fixtures are preferably those described in copending application Ser. No. 966,601, filed Dec. 5, 1978, in the name of Dennis Capewell et al and assigned to the assignee of this invention. Finally, while any desired high frequency inverter circuit can be used, the inverter shown in copending application Ser. No. 966,643, filed Dec. 5, 1978, in the name of Dennis Capewell et al and assigned to the assignee of this invention is particularly useful with this invention.

With the inverter of this invention, the use of the single inverter permits it to be designed with many features with high reliability at low cost. Thus, all complexity is confined to a single unit rather than being repeated over many fixtures. The single inverter can be located to enjoy full air circulation and may be easily cooled. When dimming with a single inverter, all lamps track in intensity. Since dimming is obtained by inverter output amplitude control, simple, low cost and highly reliable equipment can be used in the fixture. Thus, the fixture for lamp and ballast has only a small number of small, low loss, highly reliable capacitive and inductive and transformer components.

DETAILED DESCRIPTION OF THE DRAWINGS

Figure 1:
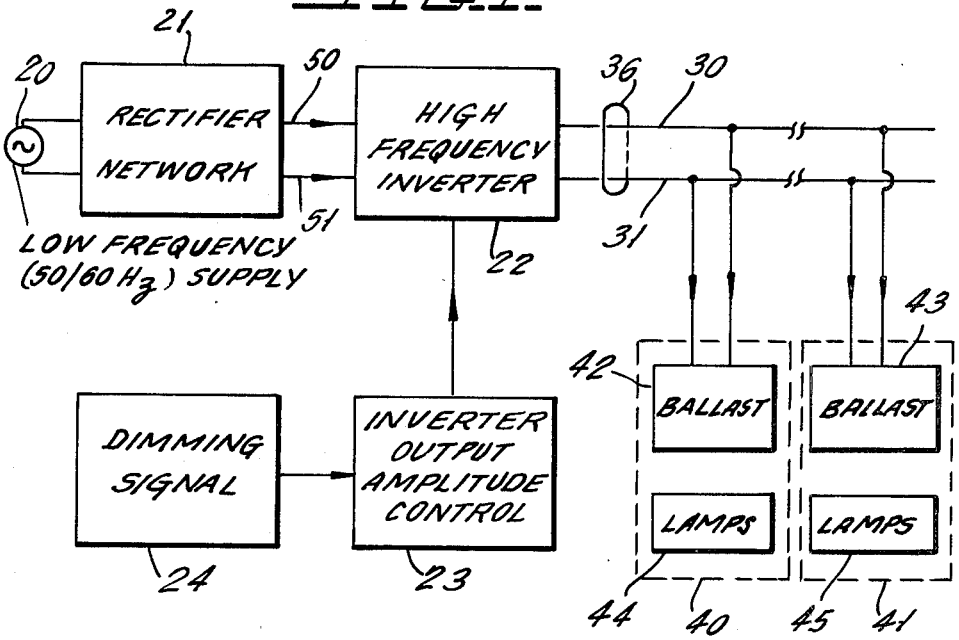
FIG. 1 is a block diagram showing the essential components of the present invention.

Referring first to FIG. 1, there is shown a relatively low frequency (for example, from 25 to 60 Hz) source 20 which is connected to a rectifier network 21 which produces rectified output power for a single central inverter 22. Source 20 and network 21 can be replaced by any appropriate d-c supply or can be driven from the d-c battery of an emergency battery which is charged or energized from a power line. In addition, although the use of a d-c supply powering an inverter is most suitable, it is also possible to use a frequency converter in a manner similar to that shown in U.S. Pat. No. 3,731,142 dated May 1, 1973, in the names of Joel Spira and Joseph Licata where, for example, a-c voltage or an unfiltered rectified d-c voltage is fed directly to a frequency converter. Rectifier network 21 may be of the type shown in FIG. 5 which will be later described, and which has high power factor characteristics. Inverter 22 will be later described in connection with FIG. 3 and produces a sinusoidal a-c output wave shape at a frequency of about 23 kHz. The output of inverter 22 is preferably higher than about 20 kHz to be above the audio range, and can be as high as permitted by semiconductor switching losses, component losses, and the like which increase with higher frequencies. Note that if the apparatus is installed in an area where audio noise is not important, the inverter output need be higher than only about an order of magnitude greater than the input line frequency.

An inverter output amplitude control circuit 23 is connected to inverter 22 and, under the influence of a signal from dimming signal control device 24, will increase or reduce the amplitude of the wave shape of the high frequency output of inverter 22. The control device 24 can be a manual control or can be derived from such devices as photocell controls, time clocks, and the like which apply some desired condition responsive and/or temporal responsive control to inverter 22.

The output of inverter 22 is then connected to two leads 30 and 31 of a transmission line which is particularly well adapted to distribute the high frequency power output of inverter 22 over relatively long distances with relatively low loss. By way of example, the lines 30 and 31 could have a length of about 100 feet, and could supply power to about twenty-five discrete spaced fixtures which each might contain two lamps. In this use, 1850 watts must be provided to the system with a power factor of about 0.9.

Note that this installation could consist of fifty 40-watt fluorescent lamps which require 2500 watts at 60 Hz. Only 1850 watts are needed at the higher frequency and with the novel system of the invention for the same light output.

Note further that only two wires are needed to carry power to lamp fixtures with the present invention as contrasted to the need for four wires in fixtures which locally contain inverter circuits and are connected to easily transmitted low fequency (50/60 Hz) power.

Figure 2:
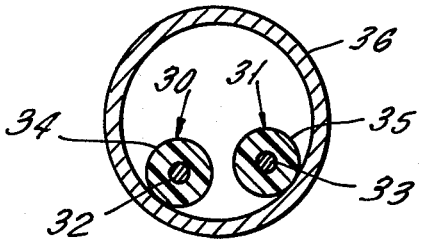
FIG. 2 is a cross-sectional view of a preferred transmission line for connecting the output of the inverter to the ballasts and lamps in FIG. 1.

FIG. 2 shows a preferred form of the novel transmission line of the invention for distribution of high frequency high power energy, as contrasted to well known arrangements for the distribution of high frequency, low power signalling voltages. In FIG. 2, lines 30 and 31 are formed of respective central conductors 32 and 33, respectively, which each consist of nineteen strands of copper wire having diameters of 0.014 inch. The outer diameter of the bundle of strands is about 0.070 inch. Each of conductors 32 and 33 are covered with dielectric sheaths 34 and 35, respectively, which may be of any suitable conventional insulation. Each of sheaths 34 and 35 have diameters of 0.235 inch and are preferably at least about three times the diameter of their respective central conductor. Strands 30 and 31 are then contained in a grounded steel conduit 36 which may be a so-called ¾ inch conduit which has an inner diameter of about 0.825 inch and an outside diameter of about 0.925 inch. The transmission lines 30 and 31 are confined in conduit 36 for a major portion of their lengths, as needed by the particular installation.

Note that the dimensions given above are only typical and that other dimensions could be selected. By using relatively thick insulation sheaths 34 and 35, the capacitive coupling and thus losses between conductors 32 and 33 and from the conductors 32 and 33 to conduit 36 are minimized. Thus the transmission line will have low loss qualities, even if it extends long distances. Note that any desired connection can be used if the distance from inverter 22 to its loads is short.

By using maximum thickness insulation sheaths 34 and 35 which can still be conveniently drawn through conduit 36, the electric field intensity is reduced, thereby to reduce bulk loss resistivity. In the past, it was believed necessary to use a minimum dielectric thickness to minimize dielectric volume and thus dielectric loss. The present invention departs from this conventional approach in order to reduce the shunt capacitive losses between the wires and from the wires to the conduit.

The relatively thick insulation sheaths 34 and 35 also minimize magnetic field losses incurred by coupling with the ferrous metal conduit. The lower magnetic loss is due to the greater distance of the conductors 32 and 33 from the ferrous metal conduit. The magnetic field varies inversely as the distance from a conductor. Energy losses due to the presence of ferrous metal in a magnetic field vary directly as a square of the magnetic field intensity. Therefore, it is seen that these losses vary inversely as the square of the distance between the conductors and the ferrous metal conduit. This permits use of ferrous conduits, rather than aluminum or other non-ferrous materials. Preferably, the characteristic impedance of the transmission line should be matched to that of the load to reduce the VAR loss and variation in voltage along the line.

The transmission line conductors 30 and 31 extend through a building or along a roadway, or the like, and are connected to one or more remote fixtures. Two fixtures 40 and 41 are shown for illustration purposes, but any number can be used. Fixtures 40 and 41 each contain ballasts 42 and 43, respectively, and associated gas discharge lamps 44 and 45, respectively. A typical ballast and lamp assembly will be later described in connection with FIG. 4. Lamps 44 and 45 may be fluorescent or high intensity gas discharge lamps or any other desired type of gas discharge lamp. Ballasts 42 and 43 preferably use passive linear components such as reactors (of relatively small size because of the relatively high frequency applied to the ballast) and capacitors which are reliable and inexpensive. Note that in a prior high efficiency 60 Hz ballast, there was a ballast loss of about 12 watts in the fixture so that the fixture is quite hot. With the present invention, the ballast loss in the fixture is less than 1 watt. Thus the components in the ballast are not subject to high temperature.

In operation, high frequency power (above about 20 kHz) is transmited from inverter 22 over the transmission lines 30–31 with relatively low loss and is distributed to the plurality of remotely located and simple and reliable ballasts 42 and 43 and their associated lamps 44 and 45, respectively.

In order to dim the output of all the lamps 44 and 45 in an identical manner, a signal from signal source 24 (which can be a manual control, a clock control, a control from the electric utility to control utility loading, a sunlight intensity responsive control, or the like) causes the inverter output amplitude control circuit to reduce the output amplitude of the a-c output of inverter 22. The light output of lamps 44 and 45 will then decrease roughly proportionally to the reduction in power from inverter 22.

Figure 3:
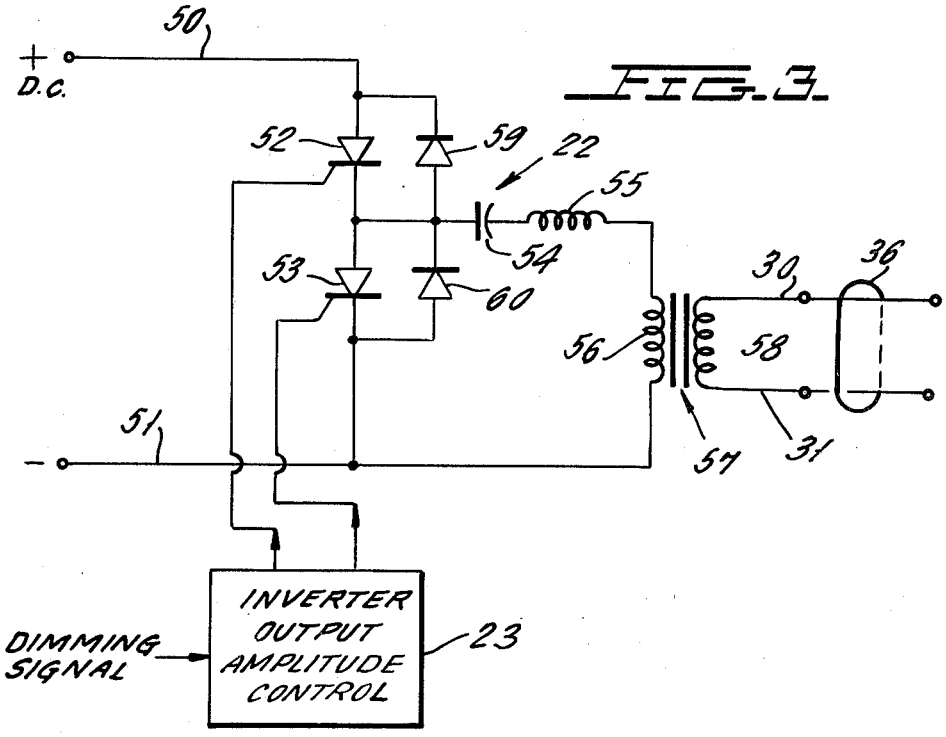
FIG. 3 is a circuit diagram of a preferred inverter which can be used in the diagram of FIG. 1.

Any desired inverter circuit having a variable a-c output can be used for the inverter 22. FIG. 3 shows a novel inverter circuit which can be used with the present invention. A circuit similar to that of FIG. 3 is shown in the pulication *An Improved Method of Resonant Current Pulse Modulation for Power Converters,* Fancisc C. Schwartz, IEEE Transactions, Vol. IEC 1–23, No. 2, May, 1976; and are also shown in U.S. Pat. No. 3,663,940 to Francisc Schwartz. That circuit, however, does not obtain variable amplitude adjustment with constant frequency as is the case of FIG. 3.

In FIG. 3, the d-c output of rectifier 21 is applied between d-c positive bus 50 and the negative or ground bus 51 which are connected across series-connected, high speed thyristors 52 and 53. Thyristors 52 and 53 have turn-on speeds of less than about 1 microsecond and turn-off speeds of about 2 to 3 microseconds. The junction between thyristors 52 and 53 is connected to series-connected capacitor 54, inductor 55, the primary winding 56 of step-up transformer 57 and the ground bus 51. Transformer 57 has a high voltage secondary winding 58 which delivers a high frequency sinusoidal output voltage of about 255 volts a-c for a d-c input voltage of about 320 volts.

Suitable bypass diodes 59 and 60 may be connected across thyristors 52 and 53, respectively. Capacitor 54 and inductor 55 have values chosen to be resonant at about 23 kHz. Thus, capacitor 54 may have a value of 0.33 microfarads and inductor 55 may have a value of about 130 microhenrys.

Amplitude control circuit 23 provides timed output gate pulses to thyristors 52 and 53 to control their operation, and these pulses are phase-controlled by the dimming signal.

In operation, and to start the inverter, consider that both thyristors 52 and 53 are off. A gate pulse from control 23 first turns on thyristor 52 to create a current path through components 50, 52, 54, 55, 56 and 51. The gate pulse to thyristor 52 is removed after a few microseconds and when conduction of thyristor 52 is fully established. Since capacitor 54 and inductor 55 are resonant at about 23 kHz, the current in the above circuit goes through a half cycle at the resonant frequency and, when it comes close to zero, thyristor 52 is commutated off, and the current reverses and flows through the path 51, 56, 55, 54, 59 and 50.

At this point, a pulse from control 23 turns on thyristor 53 so that a resonant current (and energy stored in the resonant circuit) can now reverse and flow through the circuit including components 53, 56, 55 and 54 in a resonant half cycle. The triggering pulse from circuit 23 is removed after conduction is established in thyristor 53. Thus, when the current at the end of this negative half cycle approaches zero, the thyristor 53 is commutated off and the current reverses into the positive half cycle and flows through components 60, 54, 55 and 56. The next pulse from control 23 turns on thyristor 52 as the resonant current swings into its positive half cycle to complete a full cycle of operation.

Obviously, a high output voltage is induced into output winding 58 during this operation which is subsequently applied to the transmission line consisting of conductors 30 and 31.

Amplitude variation is obtained by delaying the application of the firing signal to thyristors 52 and 53 and thus varying the duty cycle of the inverter. Thus, the conduction time of the thyristors, during the half cycle, is reduced and less voltage is applied to the primary winding 56. However, the voltage to winding 56 is sinusoidal due to the resonance of capacitor 54 and inductor 55. Thus the voltage fed to ballasts 42 and 43 (FIG. 1) is also sinusoidal. Amplitude variation may be obtained by variable delay of the firing signal to either or both thyristor switches.

As will be later described, the ballasts 42 and 43 are tuned to the output frequency of inverter 22. The sinusoidal wave form reduces inefficiency due to harmonics and also reduces production of electromagnetic interference. However, as mentioned previously, non-sinusoidal wave forms can also be used with the invention.

Note that any desired inverter circuit and control could be used in place of inverter 22 including arrangements for varying the voltage at bus 50; pulse width modulation techniques; transistorized circuits; and the use of a high frequency variable ratio transformer, or other circuits using similar controllably conductive devices.

While some aspects of the particular inverter circuit of FIG. 3 are known, it was never previously used for gas discharge lamp control purposes. This is because in ordinary lamp applications, the lamps would go out if the voltage input is reduced. However, in the present invention, the lamps stay on and dim as input voltage amplitude is decreased because the lamps are operated at high frequency and are provided with a special and suitable passive linear ballast.

Figure 4:
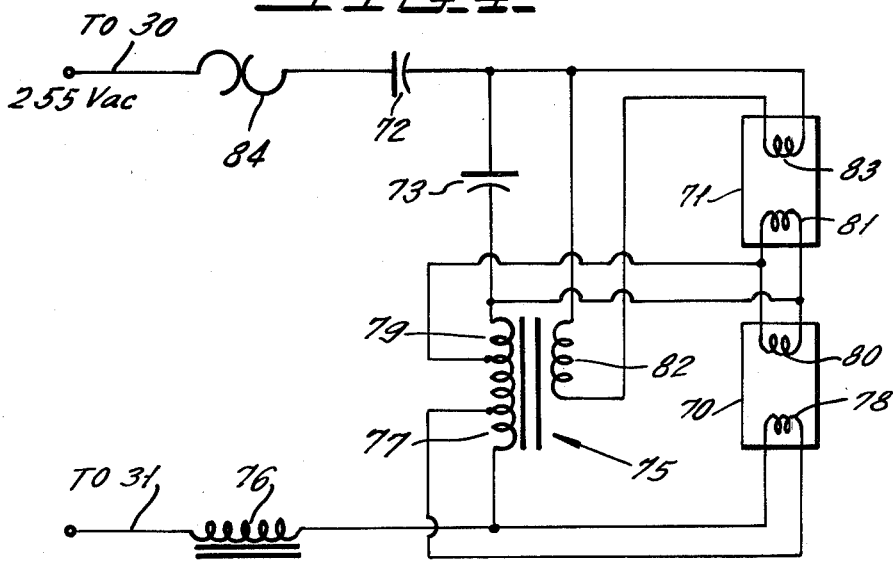
FIG. 4 is a circuit diagram of a ballast and lamp structure which can be used in the block diagram of FIG. 1.

A novel ballast arrangement shown in FIG. 4 is provided for each of ballasts 42 and 43 and is the subject of copending application Ser. No. 966,601, filed Dec. 5, 1978, referred to above. The ballast of FIG. 4 is used for two series lamps 70 and 71 (equivalent to lamps 44 in fixture 40 of FIG. 1), where lamps 70 and 71 are rapid-start fluorescent lamps which are very suitable for dimming. Other gas discharge lamps could have been used.

The ballast circuit for the lamps 70 and 71 includes capacitors 72 and 73, transformer 75 and inductor 76. A winding tap 77 is connected to filament 78 of tube 70. A winding tap 79 is connected to filaments 80 and 81 of tubes 70 and 71, respectively. A winding 82 is connected to filament 83 of tube 71. Transformer 75 has a primary winding of about 235 turns. Taps 77 and 79 and winding 82 may be about 9.5 turns. A conventional thermally responsive switch 84 which opens, for example, at 105° C. is in series with capacitor 72.

The values of capacitors 72 and 73 and inductor 76 are chosen to be resonant at about 32 kHz while capacitor 72 and inductor 76 resonate close to about 12 kHz. Therefore, the reactive impedance of inductor 76 is greater than that of capacitor 72 at 23 kHz. By way of example, capacitor 72 is 0.033 microfarad; capacitor 73 is about 0.0047 microfarad; and inductor 76 is about 5.1 millihenrys.

The ballast circuit described above has the following desirable characteristics:

1. It will not be damaged by accidential application of 50 Hz to 60 Hz power.
2. The inverter 22 will be shorted if any one ballast component fails. Thus, the short circuit can be located more easily since the lamps in unshorted fixtures are still on.
3. The circuit exhibits a good power factor to the inverter 22 and transmission lines 30–31.
4. There is a relatively constant filament voltage over the dimming range to avoid damage to lamps.
5. The starting voltage is sufficiently high to strike the lamps under specified conditions but is not so high that the lamps can be damaged.
6. The ballast is small and efficient because the ballast transformer only handles the filament power of the lamps.

The operation of the circuit of FIG. 4 is as follows: When a-c power is applied to lines 30 and 31, and 23 kHz power causes components 72, 73 and 76 to partially resonate at their resonant frequency of 32 kHz. The increase in current flow due to this partial resonance causes the voltage on capacitor 73 to rise high enough to start lamps 20 and 21. The partial resonance is important since it affords sufficient but not excessive starting voltage which might damage lamps 70 and 71. Once lamp 71 starts, capacitor 73 is essentially shorted so that capacitor 72 and inductor 76 are resonant below the inverter frequency.

During operation, capacitor 72 blocks low frequency voltage of from 50 Hz to 60 Hz, if that voltage is accidentially applied to lines 30 and 31. Thus, accidental destruction of the ballast by low frequency power is prevented. Also, since impedance components including capacitors 72 and 73, transformer 75 and inductor 76 are connected in series, the failure of any one component will not appear as a short on the inverter 22. Thus, all lamps of all fixtures are not extinguished and the faulty component can be easily located.

Good power factor is obtained with the circuit of FIG. 4 by making the impedance of capacitor 72 close to that of inductor 76 at 23 kHz. Since the reactive impedance of components 72 and 76 subtract, the resultant is small compared to the series resistance of lamps 70 and 71. Thus, the reactive component of the load is small so that good power factor is obtained.

A relatively constant filament voltage for filaments 78, 80, 81 and 83 is assured since the primary winding of transformer 75 is connected across lamp 70. The voltage drop across this lamp is relatively constant even as the lamp is dimmed. Thus, the filament voltages remain approximately constant. Note, however, that as the amplitude of the input voltage from lines 30 and 31 is varied, the current in lamps 70 and 71 varies and the light output of the lamps varies.

The inductor 76, in addition to being a component of the power factor network, has a larger reactive impedance than capacitor 72, and thus acts as a ballasting impedance to limit current in lamps 70 and 71.

Although the arrangement of FIG. 4 shows the invention in connection with fluorescent lamps, it should be understood that the invention can be applied to the energization and dimming of any gas discharge lamp. Indeed, the invention can be used to operate and dim incandescent lamps if desired to give a user of the circuit flexibility of application. If one or more incandescent lamps are used in place of lamps 70 and 71, the ballast circuit can, of course, be eliminated.

Lamps 70 and 71 in FIG. 4 could be replaced by conventional high intensity discharge lamps, such as mercury vapor, metal halide, and high and low pressure sodium lamps. These lamps do not have filaments and are relatively immune to damage from too high a striking voltage. Thus, the ballast of FIG. 4 can be modified to remove the transformer 75 and its filament heater windings when applied to a high intensity discharge lamp.

The circuit of FIG. 4 can also be modified to place the inductor 76 across the lamp terminals in a well known circuit arrangement. With the transformer 75 removed, the capacitor 72 is designed to block 60 Hz power and to prevent shut-down of the system in case of a shorted component. Resonance is established between the inductor 76 and the capacitors in series therewith near the driving frequency of the inverter 22. Thus, before the H.I.D. lamp strikes, the circuit has a high Q and a large voltage builds up across the lamp. This provides sufficient voltage to strike the lamp arc, and the lamp becomes a lower impedance, more nearly matched to the ballast. The ballast then regulates the lamp arc current as a function of the ballast input voltage.

Any suitable ballast circuit could be used with the H.I.D. lamp where, however, the ballast is subject to an energy-conserving dimming operation.

Figure 5:
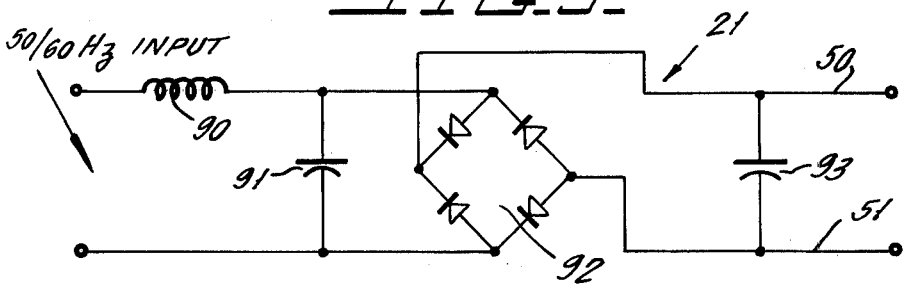
FIG. 5 is a circuit diagram of a power supply rectifier which can be used with the present invention.

FIG. 5 shows a rectifier network circuit 21 which can be used with the present invention, and which has the advantage of having a high power factor so as not to place an unnecessarily high current drain on the 50/60 Hz wiring leading to the rectifier network 21.

Copending application Ser. No. 966,603, filed Dec. 5, 1978, in the name of Dennis Capewell, and assigned to the assignee of this invention, is incorporated herein by reference, and contains a detailed description of the operation of the circuit of FIG. 5.

The circuit consists of a resonant circuit including inductor 90 and capacitor 91 connected between the input low frequency a-c source and the single phase, bridge-connected rectifier 92. The d-c output of rectifier 92 is then connected to an output capacitor 93, which may be an electrolytic capacitor, and to the positive bus 50 and ground bus 51. The values of inductor 90 and capacitor 91 are critical and are 30 millihenrys and 10 microfarads, respectively.

A detailed analysis of the circuit operation is disclosed in above-noted copending application Ser. No. (M-8903). In general, and in operation, the LC circuit 90–91 in front of rectifier 92 causes the current drawn from the 50/60 Hz input to flow for a longer time during each half cycle and to have a better phase relationship with the voltage. The inductor 90 and capacitor 91 are resonant at a period of about one-fourth of the period of the input circuit frequency (usually 50 Hz to 60 Hz). At one point of the cycle, the voltage on capacitor 93 exceeds the voltage on capacitor 91. This back-biases rectifier 92 so that line current will surge into capacitor 91 rather than cutting-off. The surging of current into capacitor 91 during reverse-biasing of rectifier 92 causes inductor 90 and capacitor 91 to resonate, thereby causing more uniform current flow from the a-c mains over each half cycle, and thereby substantially improving power factor.

It is understood that the system shown herein can also be realized with inverter 22 as a multi-phase inverter such as a three-phase inverter. In this case, the high frequency power will be distributed to ballasts and lamps by means of multi-conductor transmission line, e.g. three conductors for three-phase power. The ballasts and lamps would be connected conductor-to-conductor, or conductor to neutral, if a neutral is provided. Likewise, the low frequency 50/60 Hz supply 20 in FIG. 1 can be a multi-phase supply, e.g. three phase.

An important feature of this invention is the use of a single central inverter transformer 57 to supply the proper starting voltage to the lamps. This feature improves the efficiency of the system. In the conventional system, a transformer is contained in each fixture to supply proper starting voltage. It is well known to transformer designers that for a given voltampere size, one large transformer is more efficient than a number of smaller transformers.

The inverter transformer 57 supplies the proper starting voltage and the transformers 75 in the fixture ballasts (FIG. 4) does not have to carry full lamp power, but only carries filament power. All lamp power is supplied from the single inverter transformer 57 of FIG. 3 which is more efficient than an aggregate of smaller transformers for each ballast and for the same total volt amperes rating. Thus higher system efficiency is obtained.

Furthermore, since the ballast transformers 75 only carry filament power, the fixture ballasts are smaller, cooler, lighter, more efficient, less complex and thus more reliable than ballast transformers which must carry the full lamp power.

The ballasts will generate approximately an order of magnitude less heat than those in which lamp volt amperes must be handled by the ballast transformer. Therefore the fixture temperature is considerably lower. When fluorescent lamps are run at this resultant cooler temperature, their light output for a given input power (efficacy) increases. This effect can save an approximate additional 5% in power in a given system.

In addition to the gain in efficiency by the use of a central transformer 57, the heat produced by the lamp power volt-amperes is dissipated in the central inverter transformer 57 rather than in the individual fixtures. The central inverter transformer 57 can be efficiently cooled since it will be in a convenient and accessible location, and any desired cooling can be used.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An energy-conserving illumination control system consisting of:

a plurality of passive linear ballasts and respective gas discharge lamps therefor;

a single high frequency power source which is connected to a power input line and which has an output frequency of greater than about 20 kHz; said high frequency power source output being connected to each of said plurality of passive linear ballasts and lamps;

the output wave shape of said high frequency power source being a substantially continuous periodic wave form; and control circuit means connected to said high frequency power source for varying the amplitude of at least one of the current or voltage wave shapes of the output of said high frequency power source, thereby to vary the light intensity of each of said lamps;

the energy consumed by said illumination control system being functionally related to the output light intensity from said plurality of lamps.

2. The system substantially as set forth in claim 1 wherein said wave shape is at least approximately sinuosidal.

3. The system substantially as set forth in claim 1 which includes a high frequency power transmission line for coupling the output of said high frequency power source to each of said plurality of passive linear ballasts.

4. The system substantially as set forth in claim 1 wherein said power input line is a d-c line.

5. The system substantially as set forth in claim 2 which includes a high frequency power transmission line for coupling the output of said high frequency power source to each of said plurality of passive linear ballasts.

6. The system substantially as set forth in claim 3 or 5 wherein said transmission line includes first and second elongated conductors for coupling the output of said high frequency power source to each of said plurality of passive linear ballasts; each of said first and second conductors being covered with an insulation sheath of substantial thickness.

7. The system substantially as set forth in claim 6 wherein said first and second conductors are disposed within a ferrous metal conduit for at least a portion of their length.

8. The system as set forth in claim 6 wherein the diameter of said insulation sheath for each of said conductors is at least three times the diameter of their respective conductor.

9. The system as set forth in claim 1, 2 or 3 wherein each of said gas discharge lamps is a fluorescent lamp.

10. The system as set forth in claim 6 wherein each of said gas discharge lamps is a fluorescent lamp.

11. The system of claim 1 wherein said high frequency power source includes a series inverter comprising first and second series-connected controllably conductive devices each poled in the same direction and rectifier means for connecting rectified power from said relatively low frequency power source to said series-connected controllably conductive devices; said first controllably conductive device being connected in closed circuit relation with a capacitor, an inductor and transformer means; said capacitor and inductor being resonant at about the frequency of said high power source; and inverter output amplitude control means coupled to the resonant current of said capacitor and inductor for switching said first and second controllably conductive devices on in synchronism with said resonant frequency of said capacitor and inductor; said transformer means being connected to said ballasts.

12. The system of claim 1 wherein said controllably conductive devices are each thyristors.

13. The system of claim 11 or 12 which further includes control means to control the firing point of at least one of said first and second controllably conductive devices in each cycle to obtain control of the output amplitude of said inverter.

14. An illumination control system for the illumination and dimming of gas discharge lamps; said illumination control system including a ballast circuit for said lamps; a low frequency input supply circuit; a rectifier circuit connected to said input supply circuit; an inverter connected to said rectifier circuit for producing an output at a frequency in excess of about 20 kHz; said inverter comprising first and second series-connected controllably conductive devices each poled in the same direction, respective first and second diodes connected in parallel with said first and second controllably conductive devices respectively and poled to conduct in an opposite direction to the conduction of their respective controllably conductive device and rectifier means for connecting rectified output from said relatively low frequency power source to said series-connected controllably conductive devices; said first controllably conductive device being connected in closed circuit relation with a capacitor, an inductor and transformer means; said capacitor and inductor being resonant at about the frequency of said high power source; and inverter output amplitude control means coupled to the resonant current of said capacitor and inductor for switching said first and second controllably conductive devices on in synchronism with said resonant frequency of said capacitor and inductor; said transformer means being connected to ssid ballasts.

15. The system of claim 14 wherein said controllably conductive devices are each thyristors.

16. The system of claim 14 or 15 which further includes control means to control the firing point of said first and second controllably conductive devices in each cycle to obtain control of the output amplitude of said inverter.

17. The illumination control system of claim 1 wherein said high frequency power source includes a d-c converter for rectifying the input from said power input line and producing a d-c output; and an a-c converter for converting said d-c output into a high frequency output in excess of about 20 kHz.

18. The system of claim 17 wherein said d-c converter circuit includes:

a tuned circuit comprising an inductor and capacitor having respective values which are tuned to resonate at a frequency which is higher by less than about one order of magnitude than said relatively low a-c frequency;

coupling means for connecting said a-c supply circuit to said tuned circuit;

a rectifier means having a-c input means connected to said tuned circuit and having a d-c output circuit means; said inductor being connected in series with said rectifier means; said capacitor being connected in shunt with said rectifier means and having one terminal connected to the junction between said inductor and said rectifier means;

and an output capacitor connected to said d-c output circuit means.

19. The system of claim 18 wherein said rectifier means comprises a single phase, full-wave bridge-connected rectifier; and wherein said coupling means includes connection wires for connecting said a-c supply circuit to said inductor and capacitor respectively.

20. The system of claim 18 wherein said power input line circuit has a sinusoidal voltage and a frequency of 50 Hz to 60 Hz.

21. The system of claim 18 wherein said tuned circuit has a resonant frequency of about 3 to 6 times that of said power input line frequency.

22. The system of claim 18 wherein said coupling means includes a second rectifier means.

23. The system of claim 18 wherein the current wave shape of the current drawn from said a-c supply circuit is approximately in phase with the voltage thereof, and wherein said current has a long duty cycle which approximates a sinusoid.

24. The system of claim 1, 11 or 14 wherein said power input line is a multiphase a-c system.

25. The energy-conserving illumination control system of claim 1, 2, 3 or 4 wherein each of said ballasts contains a single ballast transformer for providing only filament power to its respective lamps.

26. The energy-conserving illumination system of claim 25 wherein said single high frequency power source includes a main ballast transformer for said lamps and for handling the volt amperes of all of said ballasts and lamps in said system.

27. The energy-conserving illumination control system of claim 11 wherein each of said ballasts contains a single ballast transformer for providing only filament power to its respective lamps.

28. The energy-conserving illumination system of claim 27 wherein said transformer means provides the start-up voltage of each of said lamps in said system.

29. The system substantially as set forth in claim 3 wherein said high frequency transmission line consists of first and second insulated conductors.

30. The system substantially as set forth in claim 6 wherein said high frequency transmission line consists of first and second insulated conductors.

31. The system of claim 1 wherein said high frequency power source includes a series inverter comprising at least one controllably conductive device and a diode connected in anti-parallel relationship with said at least one controllably conductive device; a capacitor and an inductor connected to one another and forming a resonant circuit which is resonant at about the frequency of said high power source; said at least one controllably conductive device connected in closed circuit relation with said capacitor and said inductor; transformer means connected in circuit relation with said resonant circuit; discharge circuit means connected to said capacitor; and inverter output amplitude control means for switching said at least one controllably conductive device on in synchronism with said resonant frequency of said capacitor and inductor; said transformer means being connected to said ballasts.

32. The system of claim 31 wherein said controllably conductive device is a thyristor.

33. The system of claim 31 or 32 which further includes control means to control the firing point of said at least one controllably conductive device in each cycle to obtain control of the output amplitude of said inverter.

34. An illumination control system for the illumination and dimming of gas discharge lamps; said illumination control system including a ballast circuit for said lamps; a low frequency input supply circuit; a rectifier circuit connected to said input supply circuit; and inverter connected to said rectifier circuit for producing an output at a frequency in excess of about 20 kHz; said inverter comprising at least one controllably conductive device and a diode connected in anti-parallel relationship with said at least one controllably conductive device; said at least one controllably conductive device connected in closed circuit relation with a capacitor and an inductor; transformer means connected in circuit relation with said resonant circuit; said capacitor and inductor being resonant at about the frequency of said high power source; discharge circuit means connected to said capacitor; and inverter output amplitude control means for switching said at least one controllably conductive device on in synchronism with said resonant frequency of said capacitor and inductor; said transformer means being connected to said ballasts.

35. The system of claim 34 wherein said at least one controllably conductive device is a thyristor.

36. The system of claim 34 or 35 which further includes control means to control the firing point of said controllably conductive device in each cycle to obtain control of the output amplitude of said inverter.

37. The system of claim 31 or 34 wherein said power input line is a multiphase a-c system.

38. The system of claim 1 wherein said high frequency power source has a multiphase output; each of said ballasts and lamps being connected to only one respective phase of said multiphase output.

39. The system of claim 3 wherein said high frequency source has a multiphase output; said high frequency power transmission line including a plurality of conductors each connected to a respective phase of said multiphase output, each of said ballasts connected to a respective pair of said plurality of conductors.

40. The energy-conserving illumination system of claim 1 wherein said single high frequency power source includes a main ballast transformer for said lamps and for handling the volt amperes of all of said ballasts and lamps in said system.

41. The system of claim 26 wherein said main transformer provides the starting voltage for said lamps.

42. The system of claim 40 wherein said main transformer provides the starting voltage of said lamps.

* * * * *